US010894435B2

(12) United States Patent
Hunnekens et al.

(10) Patent No.: US 10,894,435 B2
(45) Date of Patent: Jan. 19, 2021

(54) METHOD FOR PRINTING A QUALITY ASSURANCE PRINT CHART, COMPUTER PROGRAM PRODUCT, AND PRINTING SYSTEM

(71) Applicant: Océ Holding B.V., Venlo (NL)

(72) Inventors: Henri P. J. Hunnekens, Venlo (NL); Jan R. P. Van Brink, Venlo (NL); Eric N. P. Staal, Venlo (NL); Robert G. H. Lind, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/707,773

(22) Filed: Dec. 9, 2019

(65) Prior Publication Data

US 2020/0189302 A1 Jun. 18, 2020

(30) Foreign Application Priority Data

Dec. 17, 2018 (EP) ..... 18213188

(51) Int. Cl.
*B41J 29/393* (2006.01)
*B41J 2/21* (2006.01)
*B41J 11/00* (2006.01)

(52) U.S. Cl.
CPC ..... *B41J 29/393* (2013.01); *B41J 2/2146* (2013.01); *B41J 11/008* (2013.01)

(58) Field of Classification Search
CPC ..... B41J 29/393; B41J 2/214; B41J 11/008
See application file for complete search history.

(56) References Cited

U.S. PATENT DOCUMENTS

| | | | | |
|---|---|---|---|---|
| 5,447,378 | A | 9/1995 | Otsuka et al. | |
| 2003/0164955 | A1 | 9/2003 | Vinas et al. | |
| 2005/0201796 | A1* | 9/2005 | Arkin | B41J 11/008 400/76 |
| 2013/0016368 | A1* | 1/2013 | Bouverie | B41J 17/36 358/1.6 |
| 2014/0111594 | A1* | 4/2014 | Schuh | B41J 3/36 347/218 |

OTHER PUBLICATIONS

Search Report issued in European Priority Application 18213188.8, dated May 27, 2019.

* cited by examiner

*Primary Examiner* — Lamson D Nguyen
(74) *Attorney, Agent, or Firm* — Birch, Stewart, Kolasch & Birch, LLP

(57) ABSTRACT

The present invention provides a method for printing a Quality Assurance print chart, QA chart, comprising the steps of: determining the maximum print width for at least one media sheet to be printed subsequently to the printing of the QA chart, selecting from a plurality of media types designated as being suitable for QA charts, a media type that has substantially the same or a greater media width as the determined print width for the at least one media sheet to be printed subsequently, setting a print width for the QA chart substantially to the determined print width, and printing the QA chart with the set print width on the selected media type.

17 Claims, 3 Drawing Sheets

METHOD FOR PRINTING A QUALITY ASSURANCE PRINT CHART, COMPUTER PROGRAM PRODUCT, AND PRINTING SYSTEM

CROSS REFERENCE TO RELATED APPLICATIONS

This application claims priority under 35 U.S.C. § 119(a) to Application No. 18213188.8, filed in Europe on Dec. 17, 2018, the entire contents of which is hereby incorporated by reference into the present application.

FIELD OF THE INVENTION

The present invention generally pertains to printing Quality Assurance print charts (QA charts) in a printing system to monitor or control the print quality of the print system.

The present invention pertains to a method for printing a Quality Assurance print chart.

The present invention also pertains to a computer program product embodied on a non-transitory computer readable medium that, if executed on a processor, performs such a method.

Furthermore, the present invention pertains to a printing system configured to print a Quality Assurance print chart.

BACKGROUND ART

It is known to print Quality Assurance print charts (QA charts) in high productivity ink jet printers to monitor the quality of the printing process during printing. This monitoring may be automatic by automatically scanning the printed QA charts (for example with an inline scanner), analysing them, and automatically compensating for determined deviations, or manually. The printing of the QA media are typically triggered by the print engine itself as the print engine keeps track of events and developments that may require further feedback in the form of the analysis of a QA chart. The QA charts may be printed during the processing (printing) of a print job, but they are not part of the print job itself and will also typically be delivered to a separate output tray.

One typical quality aspect for which QA charts are used is nozzle failure detection (NFD) in order to be able to or supplement in the process of nozzle failure compensation (NFC). In the case of full-width print heads, the QA charts have a width equal to the maximum media width supported by the printer in order to detect nozzle failures in all nozzles. Furthermore, QA charts are typically not printed on the same media as the print job to prevent "wasting" expensive media. Instead, QA charts are typically printed on cheap media, although for some quality assessments (for example colour management) some of the media properties of the QA charts should (to some extent) match the properties of the print job in order to get a reliable quality indication that relates to the print job being printed.

Note that the term "width" as used in here is the dimension that is perpendicular to a media transport direction or print direction. So "length" refers to a longitudinal direction with regard to the media transport direction and "width" to a transverse direction regardless of which of the two is longer than the other.

A disadvantage of the known method for quality assurance is that printing QA charts, although allowing for the improvement or maintenance of print quality, negatively impacts the productivity of the printer as the printer does not directly produce prints for the print job when printing a QA chart. (Of course printing the QA chart still adds to the print job in improving or maintaining the print quality.)

The object of the present invention is to decrease the impact of the quality assurance on the productivity of the printer. This object is achieved through the embodiments and aspects as comprised in the appended claims.

SUMMARY OF THE INVENTION

In a first aspect of the present invention, a method is provided for printing a Quality Assurance print chart, QA chart, comprising the steps of: determining the maximum print width for at least one media sheet to be printed subsequently to the printing of the QA chart, selecting from a plurality of media types designated as being suitable for QA charts, a media type that has substantially the same or a greater media width as the determined print width for the at least one media sheet to be printed subsequently, setting a print width for the QA chart substantially to the determined print width, and printing the QA chart with the set print width on the selected media type.

In the prior art (FIG. 2) a QA chart 250 is printed in a sequence of sheets 201-204 of a print job. The sheets are being transported during printing along a print head or array of print heads in a media transportation direction 270. Consequently, the sheets are printed in the order: sheet 201, sheet 202, QA chart 250, sheet 203, and sheet 204. The sheets 201-204 have respective print areas 211-214. The print areas are the areas wherein marking material such as ink are to be deposited by the print heads. The areas on the sheets 201-204 outside the respective print areas are left blank, in other words, no marking material will be deposited in these areas. Note that a print area 211-214 may cover the full sheet 201-204, for example in print engines that are capable of printing up to the media edge for full bleed printing.

The QA chart 250 shown is a chart for NFD. In preconfigured areas 251-254 the print heads deposit ink. Each area 251-254 typically corresponds to a single ink colour (process colour). Each area 251-254 is printed by one or more print heads. It is for example common to use multiple print heads placed in stacked or staggered configuration in order to create a page wide print head arrangement. In each area 251-254 each nozzle corresponding to the ink colour of the corresponding area will be actuated. The QA chart is scanned after being printed and the scanner analyses which of the nozzles did not fire (or actually did not result in an ink drop on the media where it was expected). This information on failing nozzles is subsequently used for nozzle failure correction (NFC), or if NFC may no longer suffice to force a maintenance action.

The prior art systems use dedicated QA charts 250. If the dedicated QA chart 250 is wider than the subsequent media sheets 203, 204 to print on, printing the QA chart 250 will result in all print head nozzles that fit the QA chart width to be used.

The parts of the areas 251-254 that are outside the width of the print areas 211-212, designated as 259 at the top in the image—the parts on the bottom are not specifically shown in the drawing, but the same applies to these parts-will be printed by nozzles that may not have been used for some time and may be clogged. If that idle time has exceeded a threshold, a maintenance action will be scheduled by the print engine before the QA chart 250 is being printed resulting in a significant productivity loss due to the duration of the maintenance action (as well as ink waste due to the maintenance action). If the subsequent sheets 203, 204 also have a smaller width than the QA chart 250, the maintenance action is even unnecessary as the idle nozzles are not used during the printing of the subsequent sheets 203, 204 and are merely reconditioned for the printing of the QA chart 250.

The present invention prevents such an unnecessary maintenance action by forcing the printing of the QA chart to a print width that is substantially the same as the maximum print width of the subsequent media sheets and therefore preventing productivity loss due to the printing of the QA chart causing a maintenance action. The plurality of media types designated as being suitable for QA charts may be media types that were preconfigured as being suitable, for example based on criteria set by a printer operator such as cost of the media. Furthermore, the designation may be generic (i.e. suitable in general) or specific (for example suitable for NFD).

According to a further aspect of the present invention a method is provided wherein: determining the maximum print width comprises determining the maximum media width. This aspect allows for a simpler implementation as it does not require determining the print widths of the subsequent sheets. Instead it is sufficient to lookup the media width of the subsequent sheets.

In a further aspect of the present invention, a method is provided, wherein: selecting from a plurality of media types designated as being suitable for QA charts comprises selecting a media type that has substantially the same media width as the determined print width for the at least one media sheet to be printed subsequently. This aspect is especially advantageous in print engines that automatically use the full QA media width for printing the QA chart (print width=media width) without the option of using a smaller print width for a QA chart than the media width selected for the QA chart. The latter is common behaviour for QA charts for NFD, and this aspect provides a workable solution for such print engines.

According to a further aspect of the present invention a method is provided, wherein printing the QA chart comprises printing the QA chart with a print speed that is substantially the same as the print speed for the media sheet that is to be printed subsequently to the printing of the QA chart. Forcing the printing of the QA chart to the same print speed as to be used for the subsequent sheets prevents the print engine from losing time for switching print speeds. Many print engines require a greater inter-sheet distance between sheets being printed with different print speeds to allow all components along the media path to adjust to the new speed. Therefore, switching print speed will lead to productivity loss. Forcing the QA chart to be printed at the same print speed as the subsequent sheets 203, 204 will prevent such productivity loss. However, printing on a print speed that is not optimal for the selected media type may cause print quality issues. For a QA chart for NFD, this is not an issue though.

For QA charts for colour management, a print speed not matching the optimal print speed of a media type may cause issues though. Therefore, according to an alternative aspect of the present invention a method is provided wherein selecting from a plurality of media types comprises selecting a media type that has a print speed associated with it that is substantially the same as the print speed associated with the media type of the media sheet that is to be printed subsequently to the printing of the QA chart.

In one embodiment according to the present invention a computer program product is provided embodied on a non-transitory computer readable medium that, if executed on a processor, performs the steps of any of the above methods.

In another embodiment according to the invention a printing system is provided, configured to print a Quality Assurance print chart, QA chart, comprising: a storage storing a media catalogue, the media catalogue comprising entries for print media types, the entries comprising a media width and, if applicable for the particular media type, a designation whether the media type is suitable for printing a QA chart, a sheet scheduler storing a sequence of sheets to be printed including for a sheet the media type to print on, and a Quality Assurance module that is configured to, upon determining that a QA chart is to be printed at a position between two subsequent sheets in the sequence of sheets to be printed, print a QA chart, wherein printing a QA chart comprises: printing on a media type selected from the media types designated as being suitable for printing the QA chart and with a media width substantially the same as or greater than the maximum print width for at least one media sheet to be printed subsequently to the printing of the QA chart, and printing with a print width substantially the same as the maximum print width of the at least one media sheet to be printed subsequently to the printing of the QA chart.

The printing of the QA chart typically occurs on a recurring basis.

According to a further embodiment of the present invention, a printing system is provided, wherein printing a QA chart comprises: printing on a media type with a media width substantially the same as or greater than the maximum media width for at least one media sheet to be printed subsequently to the printing of the QA chart, and printing with a print width substantially the same as the maximum media width of the at least one media sheet to be printed subsequently to the printing of the QA chart.

In another embodiment of the present invention a printing system is provided, wherein printing a QA chart comprises: printing on a media type with a media width substantially the same as the maximum media width for at least one media sheet to be printed subsequently to the printing of the QA chart.

According to a further embodiment of the present invention a printing system is provided, wherein printing a QA chart comprises printing the QA chart with a print speed that is substantially the same as the print speed for the media sheet that is to be printed subsequently to the printing of the QA chart.

In again a further embodiment of the present invention a printing system is provided wherein printing on a media type comprises printing on a media type that has a print speed associated with it that is substantially the same as the print speed associated with the media type of the media sheet that is to be printed subsequently to the printing of the QA chart.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE PREFERRED EMBODIMENTS

Figure 1:
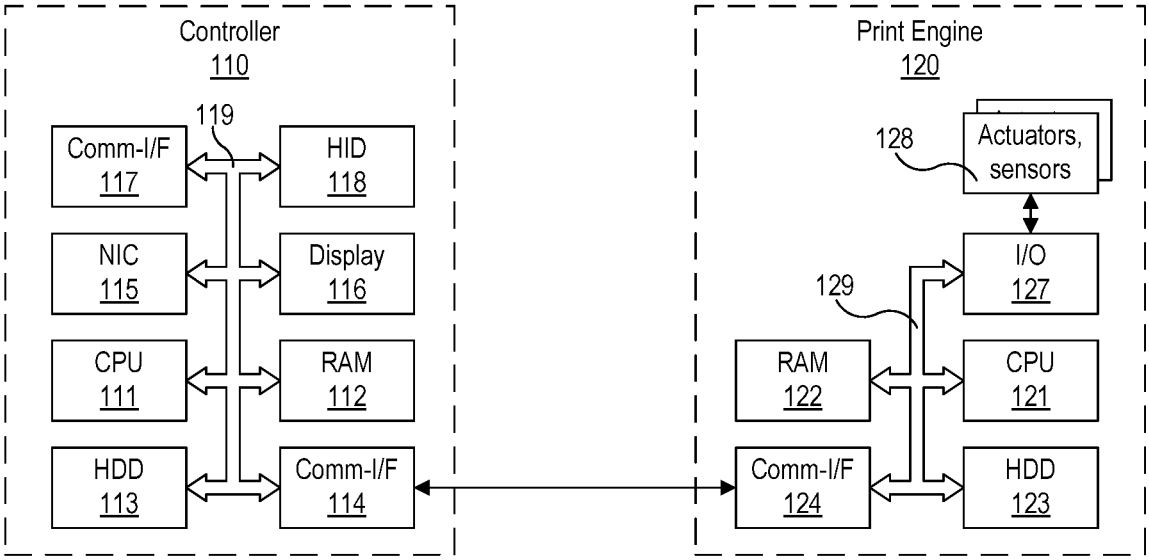
FIG. 1 is a block diagram showing the components of a general printer to which the invention may be applied.

The present invention will now be described with reference to the accompanying drawings, wherein the same reference numerals have been used to identify the same or similar elements throughout the several views.

A typical reprographic apparatus (FIG. 1) such as a printer generally comprises a controller 110 and an engine 120.

The engine 120 is responsible for low-level control of the apparatus. It deals with individual hardware components that are responsible for the reprographic process such as drives for media transport, media detectors (in the media path as well as in the input and output media trays), path switches, fusers, print heads, etc.; in general actuators and sensors 128. These actuators and sensors are connected through input/output (I/O) boards 127 to a bus 129. The bus 129 connects the major components in the engine 120. Actual data processing takes place in a central processing unit (CPU) 121. The CPU 121 reads sensor values from the sensors 128 through the I/O 127. Based on these sensor values and other data such as print data and print commands received from the controller 110, the CPU 121 determines how the engine 120 should respond to this information and determines appropriate actuation values that are sent through the I/O 127 to the actuators 128. The engine 120 comprises a volatile memory such as a random access memory (RAM) 122 to temporarily store data for processing such as the print data and print commands received from the controller 110, and the sensor values read from the sensors 128. Furthermore, a non-volatile memory such as a hard disk drive (HDD) 123 serves to store data in a more permanent manner, for example to survive a power down of the system. This hard disk drive 123 typically also stores embedded software comprising computer instructions that are run on the CPU 121. The engine 120 typically runs a real-time Operating System (RTOS), for example a soft real-time Operating System in order to deal with the time critical functions of controlling the actuators 128. The engine 120 further comprises a communication device 124 to communicate with the controller 110. Typically, the engine 120 receives print data and print commands from the controller 110 and provides back status information on the engine 120 itself and on the processing of the print commands and print data, including sending error messages to the controller 110.

The controller 110 is connected to the engine 120 through a communication device 114 that communicates with the communication device 124 of the engine 120. These communication devices 114, 124 may be implemented as Ethernet network interface controllers (NIC). Processing in the controller 110 is done by a CPU 111 that is connected to all the other components in the controller 110 through a bus 119. The data to be processed is temporarily stored in a volatile memory such as RAM 112, while data is stored in a more permanent manner in a non-volatile memory such as hard disk drive 113, for example in order to survive power downs, but also to relieve the volatile memory 112 which typically has a smaller storage size. The hard disk drive 113 typically stores print jobs, each comprising print data and a job ticket. Furthermore, the hard disk drive 113 comprises converted print data which is print data converted to a format suitable for processing by the engine 120. Typically the converted print data comprises raster images. Converting the print data in the print jobs to converted print data is typically done in a Raster Image Processor (RIP). Although the RIP may be a dedicated hardware device, it is common to be implemented in software and running on CPU 111. As the RIP-process is rather computationally intensive, it is common for controllers 110 to have multiple processing units in the form of a multi-core CPU 111 or multiple CPUs 111. The controller 110 further comprises a display 116 to show messages to an operator, or display a complete graphical user interface (GUI) to an operator for operating the reprographic apparatus. The display 116 is supplemented by a human interface device (HID) 118 such as a keyboard, mouse, touchpad, stylus, or touch sensitive panel integrated into display 116, and allows the operator to operate the reprographic apparatus. The controller 110 comprises a communication interface 117 for communicating with peripheral devices such as finisher, for example, stackers, staplers, binders, punchers, cutters, trimmers, folders, media input units, etc. The controller 110 further comprises a network interface card (NIC) 115 to connect the controller 110 to a computer network. Through the network connection, print jobs may be submitted to the controller 110 and the results of scan jobs may be retrieved from the controller 110. For these operations the controller 110 may be directly in communication with individual workstations, or indirectly through a print server. Furthermore, the network connection may be used to remotely operate the reprographic apparatus, monitor its status, and send production data to monitoring systems, accounting systems, or business information systems. Note that in smaller printer models, specifically printers suitable for placement on desks, it is common to use communication interfaces such as USB, FireWire, or Bluetooth instead of the NIC 115.

The controller 110 and the engine 120 may be implemented in a single printer device (typical for smaller printers for low volume printing), or as two separate, but interconnected devices (typical for larger, high-volume production printers).

The engine 120 typically deals with print data on a sheet level, swath level, or even line level. The engine 120 is typically not aware of information on a document or even job level. In contrast the controller 110 typically receives print jobs comprising one or more documents, the documents typically comprising multiple pages.

Figure 2:
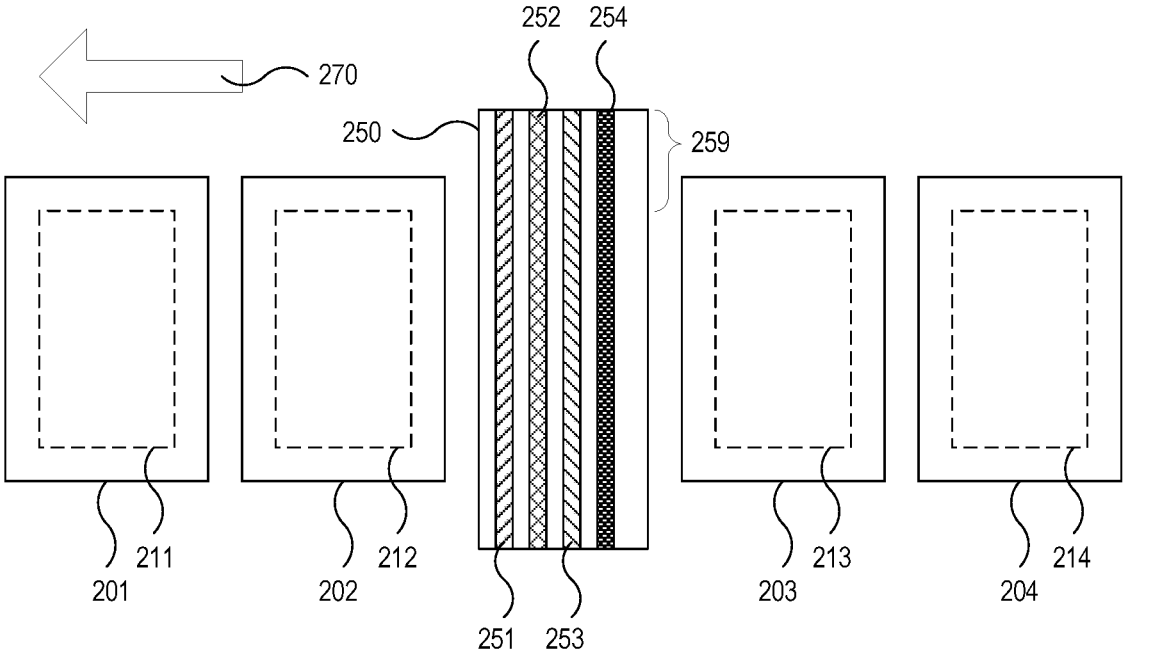
Prior Art Fig. 2
FIG. 2 is a schematic drawing showing a prior art method for printing QA charts.
Figure 3:
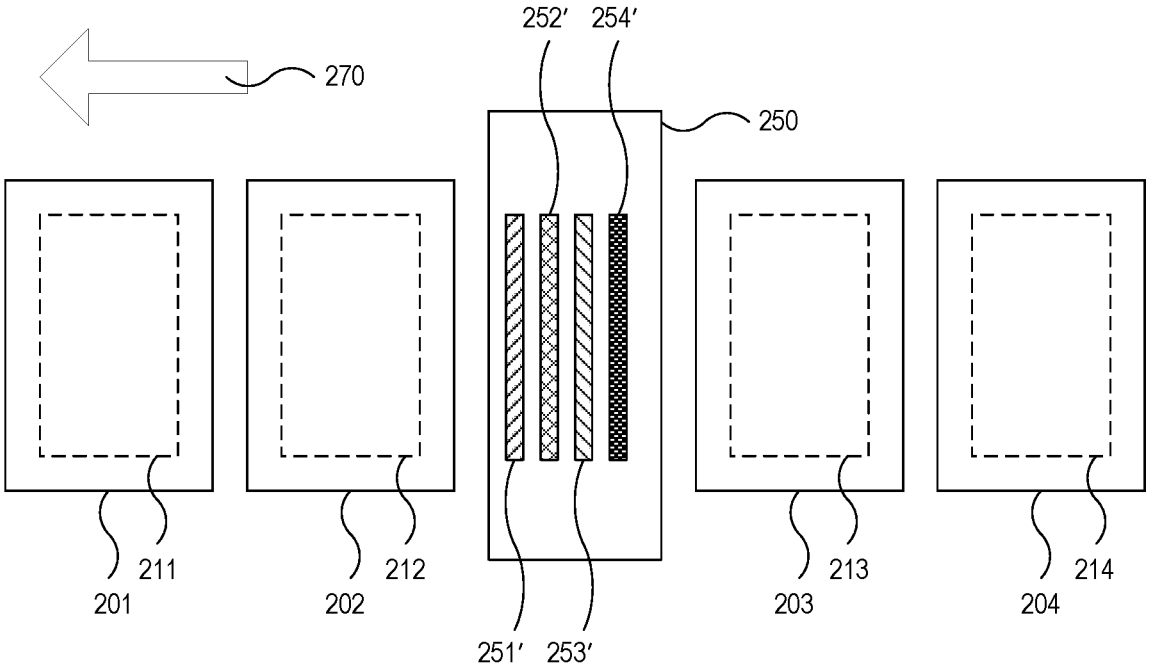
FIG. 3 is a schematic drawing illustrating a first method for printing QA charts according to the invention.

According to the invention the printed part of the QA chart will not extend beyond the print areas 213 and 214 of the sheets 203 and 204 (FIG. 3) that are scheduled to be printed after the QA chart has been printed. This means that the areas 251'-254' have been adjusted relative to corresponding areas 251-254 in the prior art situation as shown in FIG. 2, to not extend (in the direction of the page width) beyond the print areas 213 and 214 of the subsequent sheets 203 and 204. The result is that the nozzles that will not be used for printing the subsequent sheets 203 and 204, will also not be used for printing the QA charts. Therefore, any idle time of those nozzles due to these nozzles not being used in previous sheets 201 and 202 will not trigger a maintenance action. Instead of the printer wasting time (and ink) due to a maintenance action between printing sheet 202 and printing QA chart 250, the printer will immediately proceed with printing the QA chart 250 after having printed sheet 202.

Figure 4:
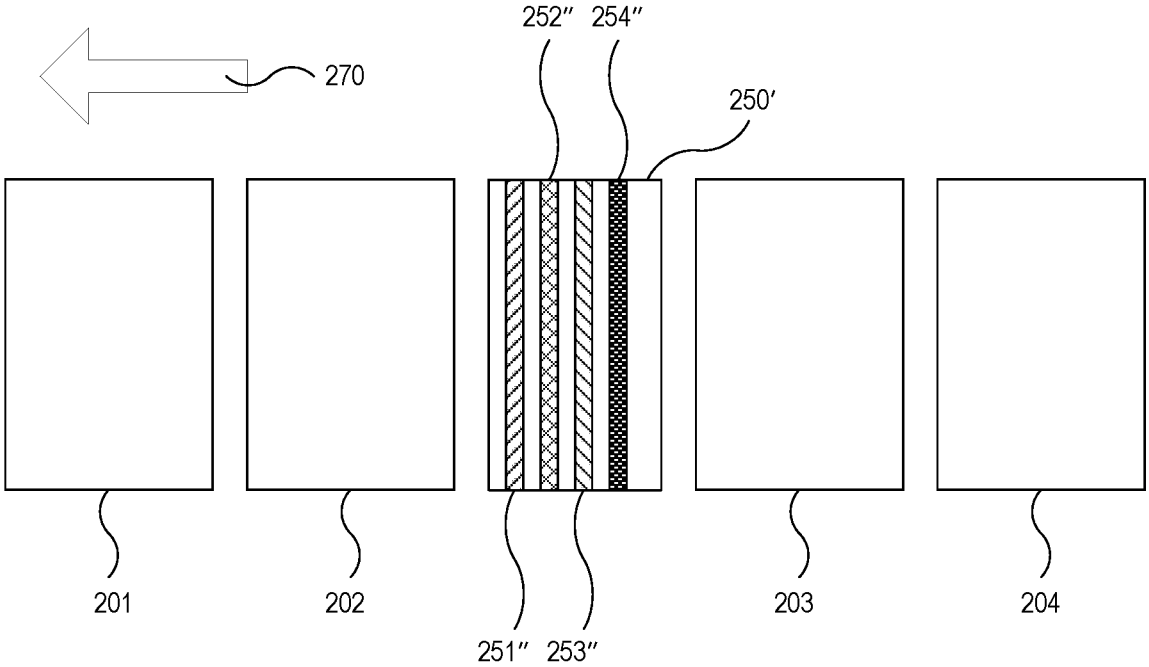
FIG. 4 is a schematic drawing illustrating a second method for printing QA charts according to the invention.

According to another embodiment (FIG. 4), the printer will not just reduce the areas 251"-254" of the QA chart 250 in width, but will additionally (or alternatively) use a media type for printing the QA chart 250' that has substantially the same width as the subsequent sheets 203 and 204. This allows the printer to use a simpler (and more-or-less more ignorant) approach by not specifically determining a print area 213, 214 of the subsequent sheets 203 and 204, but to only regard the media width for the subsequent sheets 203 and 204. After having determined the media width of the subsequent sheets 203 and 204, the printer selects a media type with substantially the same media width for printing the QA chart 250'. In this embodiment, the areas 251"-254" will typically be printed full-width (up till the media edge if the print engine has no non-printable margin, otherwise the full width of the printable area will be printed).

In a further embodiment, being an intermediate form of the previous two embodiments, the printer only regards the media width of the subsequent sheets 203 and 204, and adjusts the print width of the areas 251'-254' to be substantially equal to the media width of the subsequent sheets 203 and 204. In this embodiment, the QA chart 250 may still be printed on a media type that is wider than the media width of the subsequent sheets 203 and 204.

It is further advantageous to use a media type for the QA chart 250 that has the smallest usable media length therewith reducing the space (and time) occupied in the media path for non-productive printing (quality assurance instead of producing an actual product).

Figure 5:
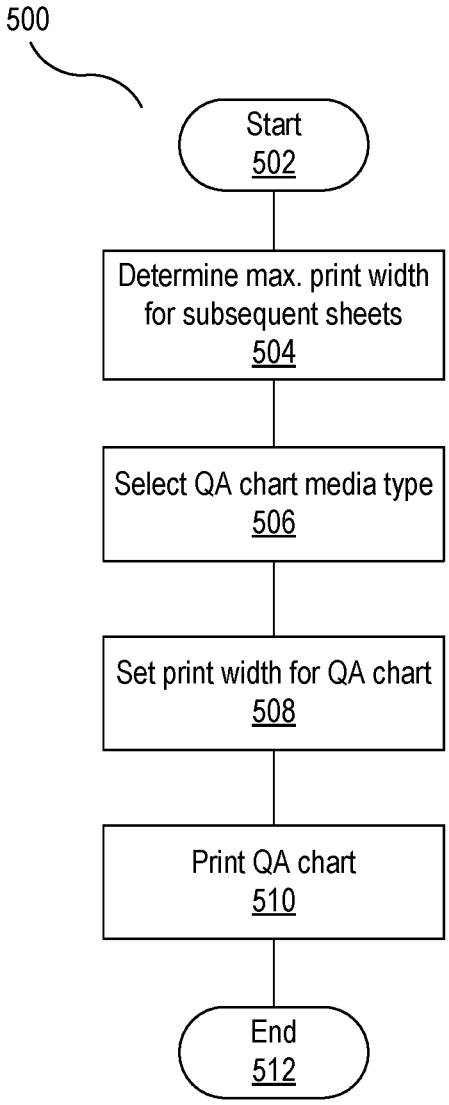
FIG. 5 is a flow diagram showing a first method according to the invention.

The first embodiment, wherein the printer adjusts the print width used for the QA chart 250 is further explained in relation to the flow chart 500 in FIG. 5. The method starts 502 with determining 504 the maximum print width 213, 214 of subsequent sheets 203, 204. The printer may only determine the print width 213 of only one subsequent sheet 203, or multiple subsequent sheets 203, 204, etc. The drawback of only looking at one subsequent sheet 203 is that if the next sheet 204 has a greater print width, a maintenance action may still be triggered, or that the QA chart 250 cannot cover for the quality of sheet 204 as it is wider (applicable for NFD). The disadvantage of taking into account too many subsequent sheets 203, 204, etc. is that at some point the QA chart 250 will become irrelevant for further sheets due to the remoteness or the effect of a maintenance action will have faded over time. For example, nozzle failures can often be resolved with a maintenance action. QA charts for NFD can be used to perform NFC in order to postpone a maintenance action (if the NFD itself does not trigger a maintenance action as described in relation to the prior art). However, if the maximum idle time for a nozzle is equivalent to, say 250 sheets, it is of no use to look beyond 250 sheets, because if the subsequent 250 sheets all have the same media width and the 251st sheet is wider, the extra nozzles used for this 251st sheet will not have been used during the previous 250 sheets and a maintenance action is therefore due anyway.

After the method has determined 504 the maximum print width for the subsequent sheets 203, 204, a media type is selected 506 from the media types available for QA chart printing, the media type having a width that is at least as wide as the media of the subsequent media sheets 203, 204. In a next step the print width for the QA chart 250 is set 508 to the maximum print width of the subsequent sheets 203, 204 as determined in the earlier step 504. Then based on the selected QA chart media type and set print width, the QA chart 250 is printed 510 and the procedure finishes 512 and is re-executed when the print engine determines that a further QA chart 250 is to be printed.

Figure 6:
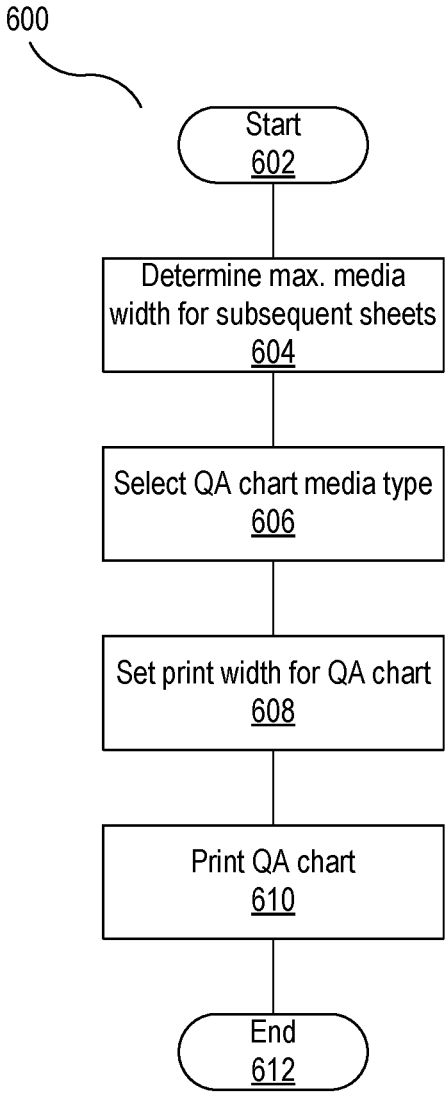
FIG. 6 is a flow diagram showing a second method according to the invention.

The method 600 according to the second embodiment is shown in FIG. 6. This method 600 corresponds to the method 500 of the first embodiment as illustrated previously with regard to FIG. 5. The steps 602 and 606-612 are equal to the steps 502 and 506-512 of method 500 respectively. The difference is in the determining step 604. Where the first method 500 determines 504 a maximum print width for the subsequent sheets 203, 204, the second method 600 determines 604 a maximum media width for the subsequent sheets 203 and 204.

Note that the embodiments shown herein use a QA chart 250 for NFD as example. However, the invention is also applicable to the printing of other types of QA charts 250, for example but not limited to colour charts. Any QA chart 250 that prints outside the print areas 213 and 214 of the subsequent sheets, may trigger an unnecessary maintenance action and therefore the present invention will be advantageous.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Method for printing a Quality Assurance print chart, QA chart, comprising the steps of:

determining the maximum print width for at least one media sheet to be printed subsequently to the printing of the QA chart, selecting from a plurality of media types designated as being suitable for QA charts, a media type that has substantially the same or a greater media width as the determined print width for the at least one media sheet to be printed subsequently, setting a print width for the QA chart substantially to the determined print width, and printing the QA chart with the set print width on the selected media type.

2. Method according to claim 1, wherein:

determining the maximum print width comprises determining the maximum media width.

3. Method according to claim 2, wherein:

selecting from a plurality of media types designated as being suitable for QA charts comprises selecting a media type that has substantially the same media width as the determined print width for the at least one media sheet to be printed subsequently.

4. Method according to claim 2, wherein printing the QA chart comprises printing the QA chart with a print speed that is substantially the same as the print speed for the media sheet that is to be printed subsequently to the printing of the QA chart.

5. Method according to claim 1, wherein:

selecting from a plurality of media types designated as being suitable for QA charts comprises selecting a media type that has substantially the same media width as the determined print width for the at least one media sheet to be printed subsequently.

6. Method according to claim 5, wherein printing the QA chart comprises printing the QA chart with a print speed that is substantially the same as the print speed for the media sheet that is to be printed subsequently to the printing of the QA chart.

7. Method according to claim 1, wherein printing the QA chart comprises printing the QA chart with a print speed that is substantially the same as the print speed for the media sheet that is to be printed subsequently to the printing of the QA chart.

8. Method according to claim 7 wherein selecting from a plurality of media types comprises selecting a media type that has a print speed associated with it that is substantially the same as the print speed associated with the media type of the media sheet that is to be printed subsequently to the printing of the QA chart.

9. A computer program product embodied on a non-transitory computer readable medium that, if executed on a processor, performs the steps of the method of claim 1.

10. A printing system configured to print a Quality Assurance print chart, QA chart, comprising:

a storage storing a media catalogue, the media catalogue comprising entries for print media types, the entries comprising a media width and, if applicable for the particular media type, a designation whether the media type is suitable for printing a QA chart, a sheet scheduler storing a sequence of sheets to be printed including for a sheet the media type to print on, and a Quality Assurance module that is configured to, upon determining that a QA chart is to be printed at a position between two subsequent sheets in the sequence of sheets to be printed, print a QA chart, wherein printing a QA chart comprises:

printing on a media type selected from the media types designated as being suitable for printing the QA chart and with a media width substantially the same as or greater than the maximum print width for at least one media sheet to be printed subsequently to the printing of the QA chart, and printing with a print width substantially the same as the maximum print width of the at least one media sheet to be printed subsequently to the printing of the QA chart.

11. Printing system according to claim 10, wherein printing a QA chart comprises:

printing on a media type with a media width substantially the same as or greater than the maximum media width for at least one media sheet to be printed subsequently to the printing of the QA chart, and printing with a print width substantially the same as the maximum media width of the at least one media sheet to be printed subsequently to the printing of the QA chart.

12. Printing system according to claim 11, wherein printing a QA chart comprises:

printing on a media type with a media width substantially the same as the maximum media width for at least one media sheet to be printed subsequently to the printing of the QA chart.

13. Printing system according to claim 11, wherein printing a QA chart comprises printing the QA chart with a print speed that is substantially the same as the print speed for the media sheet that is to be printed subsequently to the printing of the QA chart.

14. Printing system according to claim 10, wherein printing a QA chart comprises:

printing on a media type with a media width substantially the same as the maximum media width for at least one media sheet to be printed subsequently to the printing of the QA chart.

15. Printing system according to claim 14, wherein printing a QA chart comprises printing the QA chart with a print speed that is substantially the same as the print speed for the media sheet that is to be printed subsequently to the printing of the QA chart.

16. Printing system according to claim 10, wherein printing a QA chart comprises printing the QA chart with a print speed that is substantially the same as the print speed for the media sheet that is to be printed subsequently to the printing of the QA chart.

17. Printing system according to claim 16 wherein printing on a media type comprises printing on a media type that has a print speed associated with it that is substantially the same as the print speed associated with the media type of the media sheet that is to be printed subsequently to the printing of the QA chart.

* * * * *